US006968589B2

(12) United States Patent
Stewart

(10) Patent No.: US 6,968,589 B2
(45) Date of Patent: Nov. 29, 2005

(54) BARGE SWEEPER

(75) Inventor: Harold Stewart, Sorento, IL (US)

(73) Assignee: Holcim (US) Inc., Dundee, MI (US)

( * ) Notice: Subject to any disclaimer, the term of this patent is extended or adjusted under 35 U.S.C. 154(b) by 229 days.

(21) Appl. No.: 10/102,999

(22) Filed: Mar. 21, 2002

(65) Prior Publication Data

US 2003/0177596 A1 Sep. 25, 2003

(51) Int. Cl.[7] ..... E01H 1/02
(52) U.S. Cl. ..... 15/78; 15/49.1; 15/98
(58) Field of Search ..... 15/49.1, 98, 78, 15/104.05–104.33, 4, 160, 81, 201, 172

(56) References Cited

U.S. PATENT DOCUMENTS

| | | | | |
|---|---|---|---|---|
| 2,101,769 | A * | 12/1937 | Westmoreland | 15/78 |
| 3,800,358 | A * | 4/1974 | Ryan | 15/312.1 |
| 4,606,092 | A * | 8/1986 | Henning | 15/322 |
| 4,747,174 | A | 5/1988 | Hightower | |
| 5,182,830 | A * | 2/1993 | Viola | 15/78 |
| 5,251,355 | A | 10/1993 | Drumm | |
| 5,400,458 | A | 3/1995 | Rambosek | |
| 5,497,569 | A | 3/1996 | Byman | |
| 5,606,762 | A | 3/1997 | Droeser et al. | |
| 5,621,940 | A | 4/1997 | Lewis et al. | |
| 5,819,357 | A | 10/1998 | Gould | |
| 6,088,865 | A | 7/2000 | Truan et al. | |
| 6,372,101 | B1 * | 4/2002 | Barrese et al. | 204/279 |
| 2004/0255427 | A1 * | 12/2004 | Gavney | 15/401 |

* cited by examiner

*Primary Examiner*—John Kim
*Assistant Examiner*—Shay L. Balsis
(74) *Attorney, Agent, or Firm*—Harness, Dickey & Pierce, PLC

(57) ABSTRACT

The present invention provides a vehicle mounted sweeping apparatus to be mounted on a variety of vehicles for sweeping the inside surfaces of vessels such as a barge, generally comprising a rectangular steel base plate positioned horizontally with two perpendicular rectangular side plates attached to each end of the base plate. All three plates are attached to a rectangular steel frame which further comprises a mounting plate for attachment to a vehicle. The horizontal base plate and vertical side plates comprise multiple sweeping elements arranged in parallel rows perpendicular to the direction of vehicle travel and removeably attached to the outside surfaces of the plates, for replacement when worn.

12 Claims, 4 Drawing Sheets

BARGE SWEEPER

FIELD OF THE INVENTION

The present invention relates to a vehicle-mounted apparatus for cleaning the interior hull surfaces of a barge type vessel.

BACKGROUND OF THE INVENTION

Vehicle mounted brooms are well known. One of the most common types are rotary brooms is driven by auxiliary power from the vehicle on which they are mounted. Several disadvantages to sweeping apparatuses such as these include the very limited types of vehicles upon which they can be mounted, along with a high cost of manufacturing. Furthermore, rotary sweepers require higher maintenance due to the moving parts and also tend to wear much more rapidly than stationary sweepers, requiring the bristle elements to be replaced on a much more frequent basis. Another disadvantage to these type of sweeping devices is the amount of dust created when in use, limiting their uses to applications where airborne dust is not a problem.

Fixed position brooms that are attached to vehicles overcome the foregoing disadvantages in that they can be mounted on a variety of vehicles and have no moving parts that require increased maintenance. Typically comprised of a frame upon which a plurality of brushes are individually attached, brush wear is decreased, requiring replacement less frequently. Other advantages to fixed position brooms over rotary types include a greater variety of applications because of the ability to mount the brushes in several orientations and positions. Another important advantage over rotating sweepers is that fixed position brooms are significantly less expensive to manufacture.

In the fixed position vehicle mounted broom disclosed in U.S. Pat. No. 6,088,865, multiple brushes are removeably attached to the main frame of the sweeper by C-shaped channels. The invention discloses the use of extension assemblies upon which additional brushes are mounted in a similar manner to increase sweeping surface or change the sweeping angle of the brushes when combined with the main sweeping body.

Although U.S. Pat. No. 6,088,865 has several advantages over rotary sweeping devices, there are further advantages of the present invention for use in the preferred application not taught by U.S. Pat. No. 6,088,865. First, U.S. Pat. No. 6,088,865 does not teach a means of sweeping or cleaning vertical surfaces such as the inside hull surfaces of a barge as well as a means to sweep the floor, whereas the present invention overcomes this obstacle. Another disadvantage of U.S. Pat. No. 6,088,865 is the use of bristle only type brush elements that may not remove all the debris on the surface being swept due to slippage of particulate matter through the bristles or because it may be stuck to the surface. The present invention may embody resilient squeegee type blades in conjunction with brush elements to further enhance the cleaning efficiency of the sweeper.

The U.S. Pat. No. 4,747,174 embodies a vehicle mounted sweeping apparatus with brush arms that are pivotal to a vertical orientation for transportation and storage of the sweeper but are not designed to be used in that position. As a result of the aforesaid shortcomings of the prior art sweeper designs, the need arose for a vehicle mounted sweeping apparatus that has no moving parts, can sweep and squeegee vertical surfaces as well as horizontal surfaces of the inside of a vessel such as a barge, one that can be used in a variety of applications, mounted to a variety of vehicles, and manufactured with minimal time and expense.

SUMMARY OF THE INVENTION

Accordingly, it is the primary object of the present invention to provide a vehicle mounted sweeping apparatus for cleaning the inside surfaces of a vessel such as a barge or ship.

In addition, it is an object of the present invention to provide a vehicle mounted sweeping apparatus embodying removeably attached multiple brush elements that can be replaced easily as they become worn.

It is a further object of the present invention to provide for better sweeping efficiency by implementing both bristle brush elements for sweeping and squeegee blades for scraping and wiping.

Another object of the present invention is to provide a vehicle mounted sweeping apparatus with both vertical and horizontal sweeping elements to simultaneously sweep the floor and the walls of a vessel such as a barge or ship.

In addition, it is an object of the present invention to provide for a vehicle mounted, fixed position sweeping apparatus that is easy to attach and detach from a variety of vehicles.

It is also an object of the present invention to provide for a vehicle mounted sweeping apparatus that is easy to manufacture and maintain.

To achieve the foregoing objects, the present invention provides a sweeping apparatus to be mounted on a vehicle, generally comprised of a rectangular steel base plate positioned horizontally, with two perpendicular side plates mounted to each end. The plates are attached to a generally rectangular steel frame embodying gussets to reinforce the perpendicular side plates that make up the vertical sweeping elements. The present invention further embodies a means of attachment to a vehicle for pushing or pulling the sweeping apparatus implemented on the horizontal main frame. Multiple individual brooms comprising the sweeping elements are arranged in parallel sets on the bottom surface of the horizontal base plate and the outside surfaces of both perpendicular side plates, respectively. The sweeping elements are removeably attached by way of generally C-shaped channels attached to the plates and within which the broom and/or squeegee blades are received.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
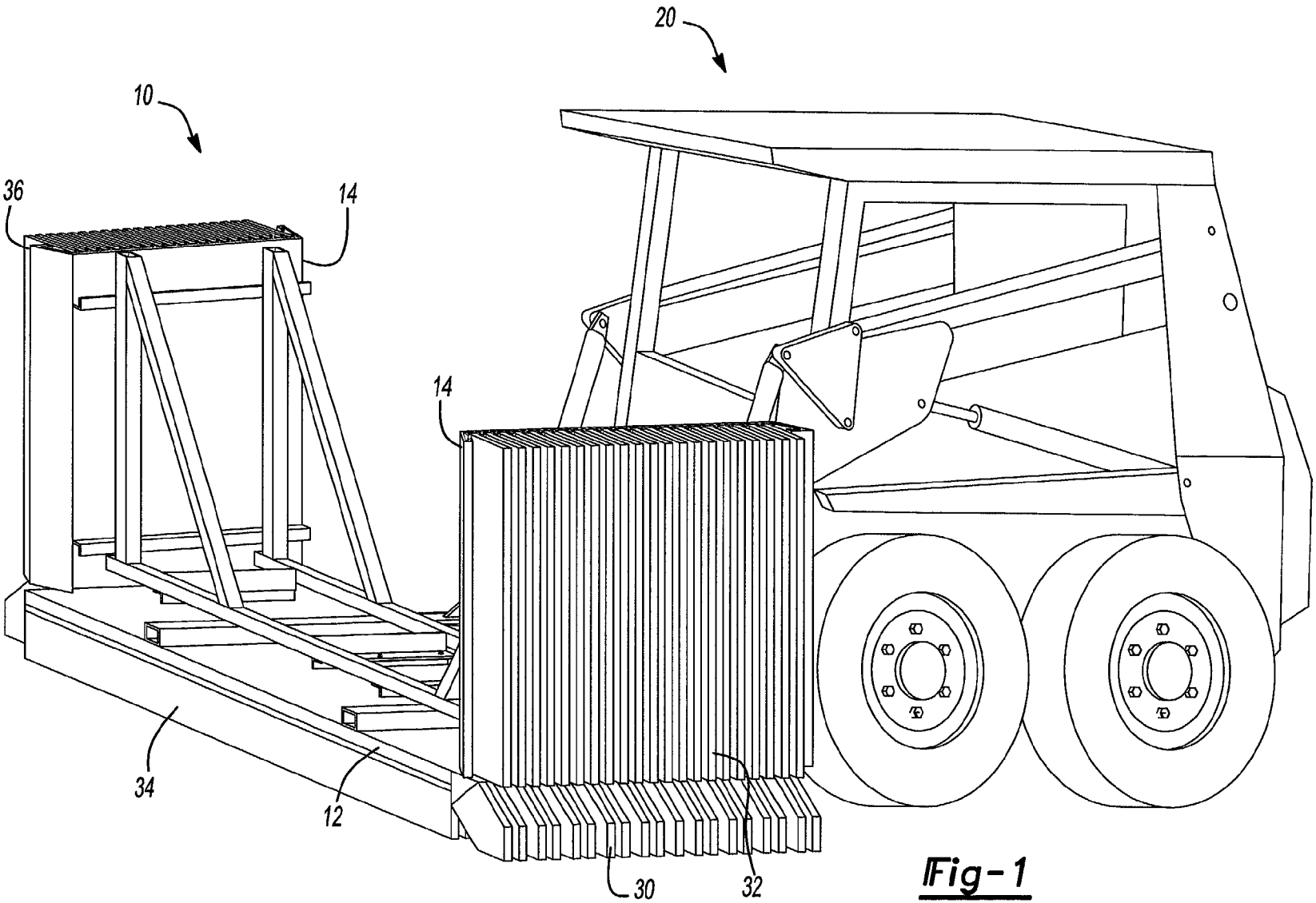
FIG. 1 is a perspective view of the vehicle mounted sweeping apparatus as mounted on a skid loader.

The following description of the preferred embodiment(s) is merely exemplary in nature and is in no way intended to limit the invention, its application, or uses. Referring to FIG. 1, a perspective view of the preferred embodiment of a vehicle-attached sweeping apparatus 10 is shown as attached to a vehicle 20. In this preferred embodiment, the sweeping apparatus 10 is mounted to the front of vehicle 20 for sweeping the inside of a vessel such as a barge or ship. The base plate 12, containing brush elements 32 and/or squeegee elements 34, is attached in such a manner as to have the brush elements 32 and squeegee elements 34 arranged perpendicular to the direction of travel of vehicle 20. The perpendicular side plates 14 also comprise parallel rows of brush elements 32 and parallel squeegee elements 34 for sweeping vertical surfaces of the barge or vessel.

Figure 2:
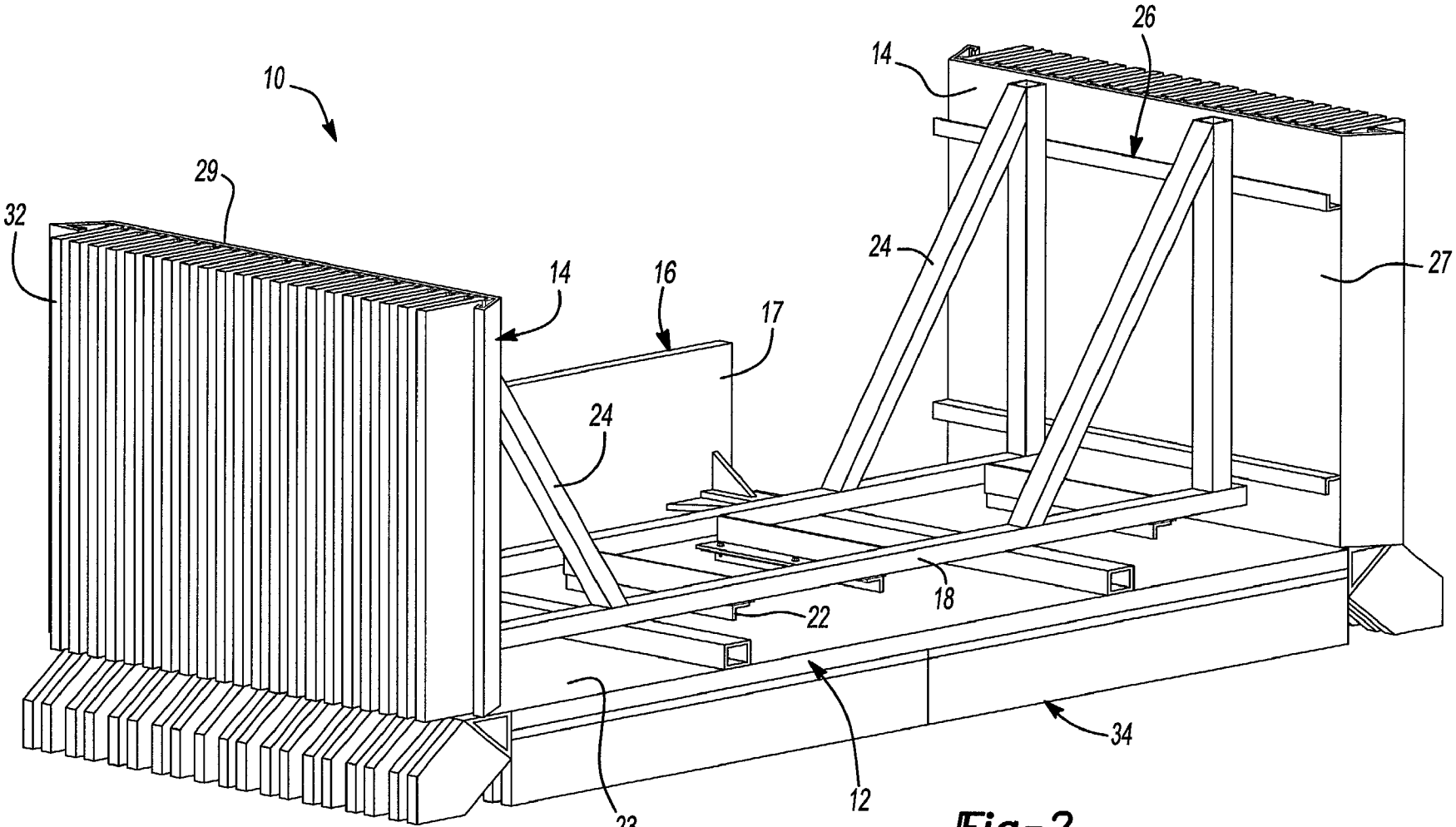
FIG. 2 is a perspective front view of the vehicle mounted sweeping apparatus, unattached to a vehicle.
Figure 3:
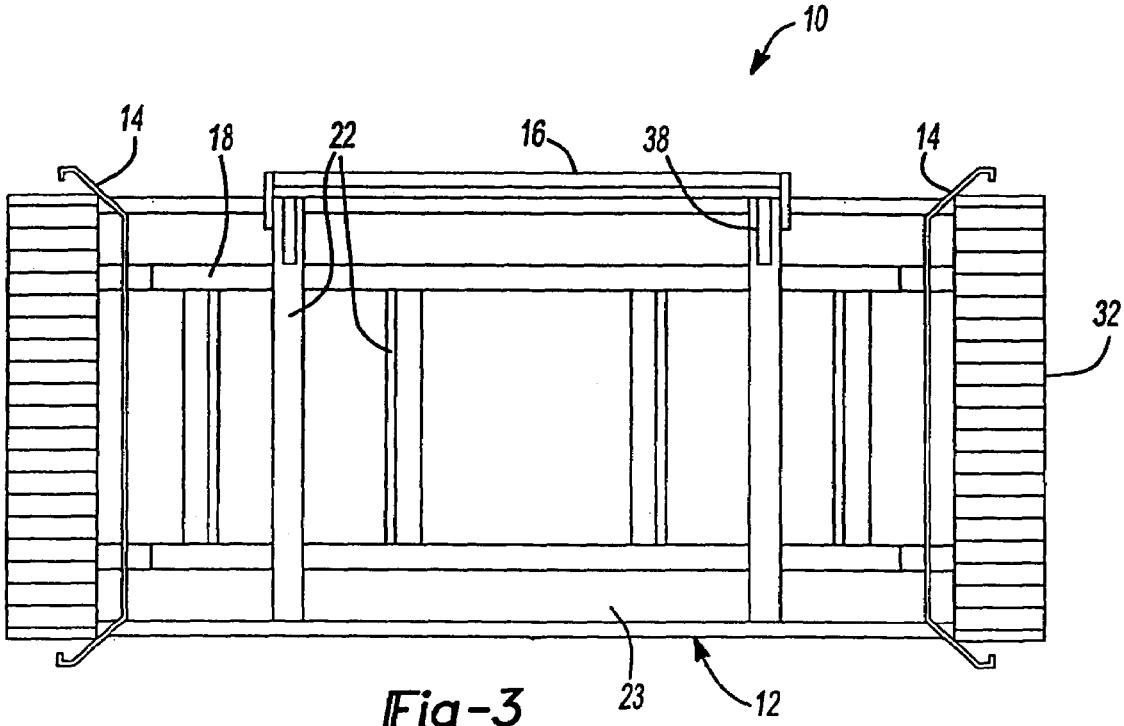
FIG. 3 is a top view of the sweeping apparatus as unattached to a vehicle.
Figure 5:
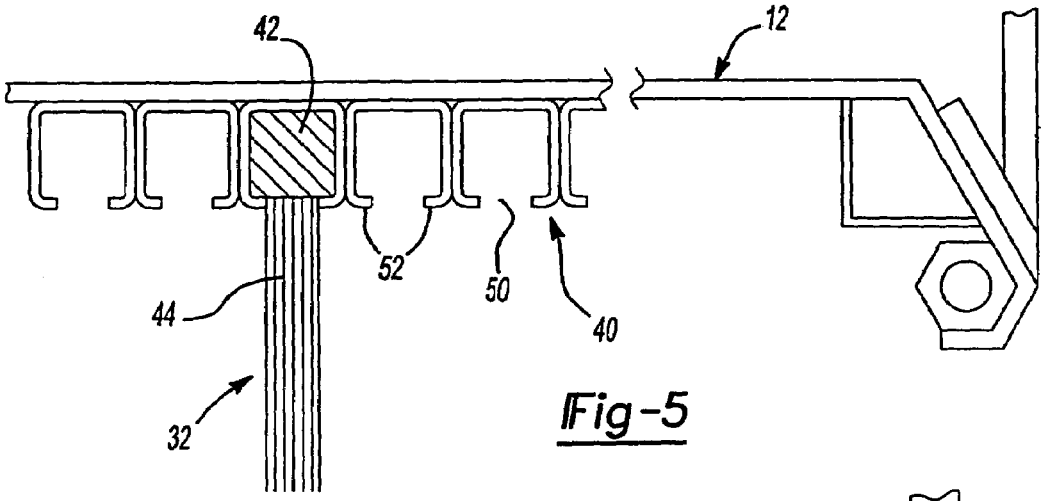
FIG. 5 is a partial cross-sectional view of the horizontal base plate with one of the broom-type sweeping elements received in one of the C-shaped channels mounted thereto.
Figure 6:
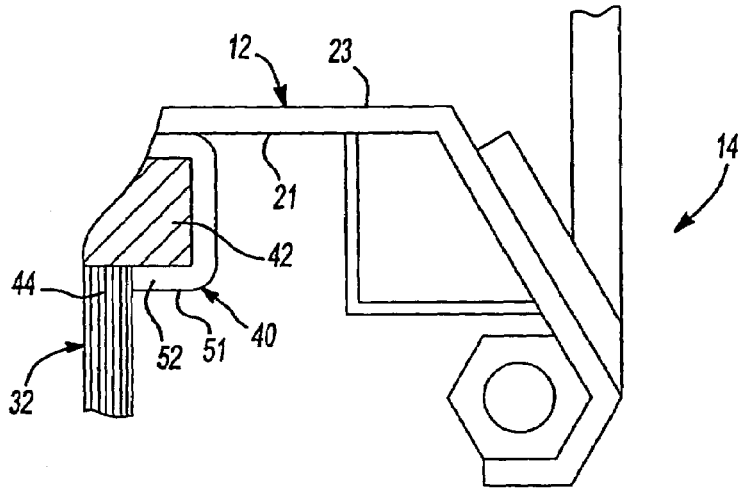
FIG. 6 is a close-up partial cross sectional view of FIG. 5, showing the corner mounting configuration of the base plate where the vertical side plate attaches to the sweeping apparatus.

Referring now to FIGS. 2 and 3, a closer view of the sweeping apparatus 10 is shown detached from a vehicle 20, embodying the base plate 12, two perpendicular parallel side plates 14, and a means of attachment to a vehicle 20, all attached to frame 18. The frame 18 comprises steel I-beam girders arranged and welded in a generally rectangular shape, further embodying a plurality of cross-members 22 of similar material, evenly spaced and mounted to the top surface 23 of the base plate 12. Support gussets 24 for increasing the integrity of the perpendicular side plates 14, attach proximally to the frame 18 located on the top surface 23 of the base plate 12. Distally, the support gusset 24 attach to a cross beam 26 mounted to the inside surface 27 of the side plates 14 proximal the top edge 29 of the side plates 14. Parallel rows of brush elements 32 are attached to the outer surface of the side plates 14 as well as to the bottom surface of the base plate 12, which may also implement resilient squeegee elements 34. These parallel brush elements 32 are removeably attached to the base plate 12 by means of multiple, C-shaped channels 40 attached to the outside surface of side plates 14 and the bottom surface of base plate 12, as shown in FIGS. 5 and 6.

FIG. 2 further shows the sweeping apparatus 10, detached from a vehicle, embodying the frame 18 attached to the top surface 23 of base plate 12 with support gussets 24 attached proximal the top edge 29 of side plates 14, by way of cross beams 26.

In viewing FIGS. 2 and 3 together, the sweeping apparatus 10 is shown unattached to a vehicle 20 embodying the base plate 12 with a top surface 23, upon which the rectangular frame 18 is attached. The vehicle mounting plate 16 is attached to two of the parallel cross members 22 mounted to the rectangular frame 18 further reinforced by triangular gusset plates 38, welded to the cross members 22 and the inside surface 17 of the vehicle mounting plate 16. FIG. 3 further shows the plurality of removeably attached vertical sweeping elements 32 which are mounted to the outside surface of the side plates 14, allowing the vehicle 20 to sweep vertical surfaces of a vessel.

Figure 4A:
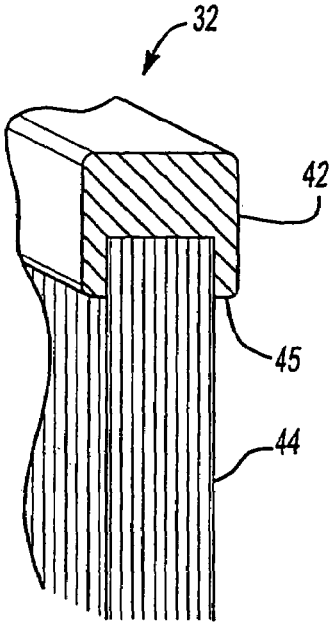
FIG. 4A perspective partial cross-sectional view of one of the sweeping elements, comprising a bristle-type broom.
Figure 4B:
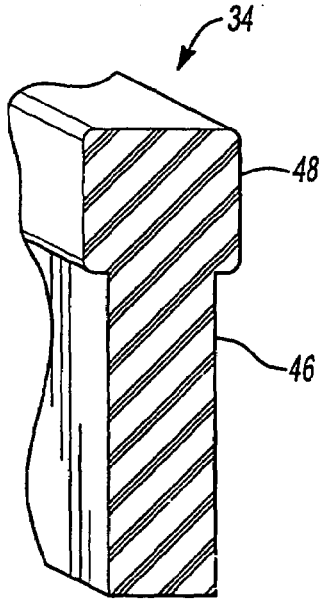
FIG. 4B is a perspective partial cross-sectional view of one of the sweeping elements, comprising a squeegee type blade.

FIG. 4 shows a cross-section of one of the brush elements 32 removeably received within the C-shaped channels 40 on the bottom side of the horizontal base plate 12 or the outside surface of the side plates 14. The brush element comprises an elongated, flanged mounting base 42, integrally formed with a plurality of generally aligned monofilament plastic bristles 44 along a first side 45 of the flanged mounting base 42, forming one continuous brush element.

In addition to the brush elements 32 used in the sweeping apparatus 10 herein, squeegee elements 34 may also be implemented in the invention, for enhanced sweeping ability, as shown in FIG. 4A. In the preferred embodiment, the individual squeegee elements 34 are comprised of a resilient rubber strip 46 integrally attached longitudinally along one end to a flanged mounting base 48, to be received by channels 40 in a similar manner as the brush elements 32, removeably attaching squeegee elements 34 to the sweeping apparatus 10 as shown in FIG. 5.

FIGS. 5 and 6 together show a cross-sectional view of the joint between one of the vertical sweeping plates 14 and the horizontal base plate 12, where in base plate 12, with top surface 23 and bottom surface 21, embody a plurality of the parallel C-shaped channels 40 of generally square cross-section attached thereto. These C-shaped channels 40 comprise an opening slot 50 along a first side 51 and two inward turned flanges 52 for maintaining the brush element 32 there within. The channels 40 are oriented and attached to the base plate 12 so that the openings 50 are facing down, perpendicular to the surface 21 of the base plate 12. Individual brush elements 32 are removeably received within channels 40 by sliding the flanged mounting base 42 into the channel 40 so that the bristles 44 are extending through opening 50 of the channel 40. The flanges 52 of the channels 40 engage with the square, flanged mounting base 42 of each individual brush element 32 to maintain the brush elements 32 within the channels 40 during use.

In addition to the brush elements 32 used in the sweeping apparatus 10 herein, squeegee elements 34 may also implemented in the invention, for enhanced sweeping ability, as shown in FIG. 4A. In the preferred embodiment, the individual squeegee elements 34 are comprised of a resilient rubber strip 46 integrated longitudinally along one end to a square, flanged mounting base 48, to be received by channels 40 in a similar manner as the brush elements 32, removeably attaching squeegee elements 34 to the sweeping apparatus.

Figure 7:
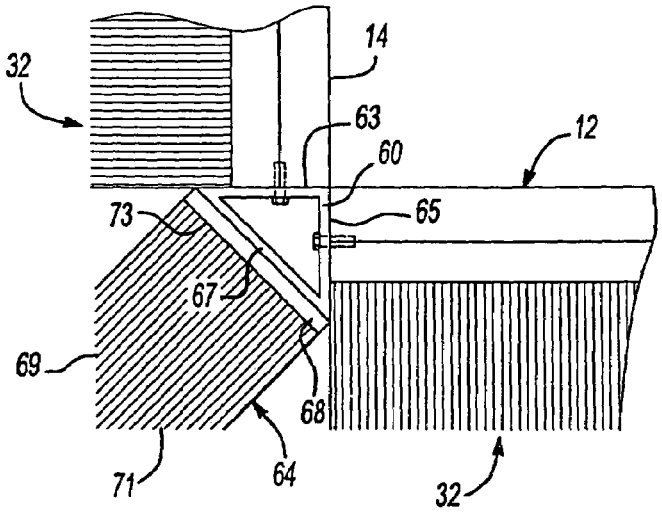
FIG. 7 is a partial side view showing the configuration of the vertical, horizontal and corner sweeping elements.

This preferred embodiment of the invention enables the sweeping of the corners of a vessel such as a barge where the wall and the floor meet, simultaneous to sweeping the floor and vertical wall surfaces thereof. Referring now to FIG. 7, a corner bracket 60 is shown, for mounting a generally triangular shaped sweeping element 64 of either the brush type 32 or squeegee type 34. The bracket 60 is of a right-triangular shape, mounted to the bottom edge 63 of the side plate 14 and the outer edge 65 of the base plate 12. The hypotenuse edge 67 of the bracket 60 has a C-shaped channel 68 similar to the channels 40 mounted on the side plates 14 and the base plate 12 of the sweeping apparatus 10. The corner sweeping element implemented is designed and shaped to have a vertical sweeping edge 69, a horizontal sweeping edge 71, and a mounting edge 73, which is comprised of an integrated square mounting base, identical to those found on the side and base brush elements 32.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A selectively attached, non-self propelled vehicle mounted sweeping apparatus for cleaning the interior surfaces of vessels such as a barge, said vehicle suitable for a plurality of alternative uses when unattached from said sweeping apparatus for comprising:

a horizontal base plate having a top surface and a bottom surface and two perpendicular side plates having an inside surface and an outside surface attached to a generally fixed U-shaped frame, said frame having angular supports extending from a center portion above said top surface of said base plate to an upper end of said side plates;

a means of attachment to said vehicle on the top surface of said horizontal base plate;

a plurality of parallel sweeping elements removeably attached to the bottom surface of said base plate, and the outside surfaces of said side plates, said sweeping elements removeably attached by means preventing rocking and lateral pivoting relative to said base plate and said side plates.

2. The vehicle mounted sweeping apparatus of claim 1, wherein said sweeping elements are removeably attached to said base plate and said side plates by a plurality of parallel channels of a general C-shape in cross section, having an opening that is outwardly facing with flanges partially closing said opening, attached to the bottom surface of said base plate and the outside surfaces of said side plates.

3. The vehicle mounted sweeping apparatus of claim 2, wherein said C-shaped channels are positioned in parallel rows, perpendicular to the direction of vehicle travel.

4. The vehicle mounted sweeping apparatus of claim 2, where in said sweeping elements comprise both a plurality of bristle elements and a plurality of resilient squeegee elements.

5. The sweeping elements of claim 4 wherein said bristle elements comprise:

a plurality of generally aligned monofilament plastic bristles, forming a continuous sweeping assembly, said bristles attached at one end to a flanged mounting base to be received by said C-shaped channels for removeably attaching said bristle elements therein.

6. The sweeping elements of claim 4 wherein said resilient squeegee elements comprise:

a resilient rubber strip attached longitudinally along one end to a flanged mounting base, to be received by said C-shaped channels attached to said sweeping apparatus for removeably attaching said squeegee elements therein.

7. A Universal vehicle mounted sweeping apparatus to be pushed or pulled by a vehicle for cleaning the inside surfaces of a vessel such as a barge comprising:

a horizontal surface sweeping base plate having a top surface and a bottom surface, and two perpendicular side sweeping plates parallel to each other having an inside surface and an outside surface, said side sweeping plates extending vertically a predetermined distance to an upper end, said predetermined distance at least one half of the width of said base plate, said base plate and said side plates attached to a generally rigid U-shaped frame, said frame having angular supports extending from a center portion above said top surface of said base plate to said upper ends of said side plates;

a means of attachment to said vehicle on the top surface of said horizontal base plate;

a plurality of parallel sweeping elements removeably attached to the bottom surface of said base plate, and the outside surfaces of said side plates; and a plurality of right triangular mounting frames attached to the outside corner joint formed between said horizontal sweeping base plate and said perpendicular side sweeping plate for sweeping corners of said vessels.

8. The triangular mounting frames in claim 7, wherein channels of a general C-shape in cross section, having an opening that is outwardly facing with flanges partially closing the opening, are attached to the hypotenuse of said frames for removeably attaching said corner-shaped sweeping elements.

9. The vehicle mounted sweeping apparatus of claim 8, wherein said corner-shaped sweeping elements comprise both a plurality of bristle elements and a plurality of resilient squeegee elements.

10. The sweeping elements of claim 8 wherein said bristle elements comprise:

a plurality of generally aligned monofilament plastic bristles, forming a continuous sweeping assembly, said bristles attached at one end to a flanged mounting base to be received by said C-shaped channels for removeably attaching said bristle elements therein.

11. The sweeping elements of claim 8 wherein said resilient squeegee elements comprise:

a resilient rubber strip attached longitudinally along one end to a flanged mounting base, to be received by said C-shaped channels for removeably attaching said squeegee elements therein.

12. In a vehicle attached barge sweeping apparatus for sweeping the interior surfaces of a large transportation vessel such as a barge a universal steerable vehicle mounted sweeping apparatus to be pushed or pulled by a vehicle for cleaning the inside surfaces of a vessel such as a barge comprising:

a horizontal surface sweeping base plate having a top surface and a bottom surface, and two perpendicular side sweeping plates having an inside surface and an outside surface, attached to a generally rigid U-shaped frame;

a means of attachment to said vehicle on the top surface of said horizontal base plate;

a plurality of at least 3 parallel sweeping elements, each having a flanged mounting base running longitudinally the length of the sweeping element, removeably attached to the bottom surface of said base plate, and the outside surfaces of said side plates;

said sweeping elements are removeably attached to said base plate and said side plates by a plurality of parallel channels of a general C-shape in cross section which securely hold said flanged mounting portion of said sweeping elements rigidly, preventing any lateral pivoting between said channel and said flanged mounting portion of said sweeping elements, said sweeping elements comprising both a plurality of bristle elements and a plurality of resilient squeegee elements, and a plurality of right triangular mounting frames attached to the outside corner joint formed between said horizontal sweeping base plate and said perpendicular side sweeping plate, said triangular mounting frames having a plurality of C-shape channels in cross section, parallel to one another and each having an opening that is outwardly facing with flanges partially closing the opening, attached to the hypotenuse of said frames for removeably holding said corner-shaped sweeping elements rigidly;

said corner-shaped sweeping elements comprising both a plurality of bristle elements and a plurality of resilient squeegee elements.

* * * * *